US005451993A

United States Patent [19]

Takahashi et al.

[11] Patent Number: 5,451,993

[45] Date of Patent: Sep. 19, 1995

[54] INK JET HEAD

[75] Inventors: Tomoaki Takahashi; Yoshinaga Takahashi, both of Tokyo, Japan

[73] Assignee: Seikosha Co., Ltd., Tokyo, Japan

[21] Appl. No.: 19,553

[22] Filed: Feb. 19, 1993

[30] Foreign Application Priority Data

Feb. 20, 1992 [JP] Japan ..... 4-033281

[51] Int. Cl.[6] ..... B41J 2/14

[52] U.S. Cl. ..... 347/47

[58] Field of Search ..... 346/140; 347/47

[56] References Cited

U.S. PATENT DOCUMENTS

| | | | |
|---|---|---|---|
| 3,823,408 | 7/1974 | Gordon | 347/47 X |
| 4,246,076 | 1/1981 | Gardner | 204/11 |
| 4,389,654 | 6/1983 | Bar-on | 347/47 |
| 4,675,083 | 6/1987 | Bearss | 204/11 |

FOREIGN PATENT DOCUMENTS

| | | | |
|---|---|---|---|
| 037439 | 2/1982 | Japan | B41J 3/04 |

*Primary Examiner*—Joseph W. Hartary
*Attorney, Agent, or Firm*—Amster, Rothstein & Ebenstein

[57] ABSTRACT

A structure for an ink jet head comprising: an ink passage adapted to be supplied with ink; a nozzle communicating with the ink passage and positioned to have exit deep from the end face of the ink jet head; a hollow portion formed in the head end face to communicate with the nozzle exit and to have a larger diameter than the nozzle; and ink ejecting means disposed to correspond to the ink passage and energized electrically to eject the ink in the ink passage out of the nozzle end face through the hollow portion. As a result, the ink droplets can always be ejected in a correct direction by suppressing the fluctuation of their flowing direction, which might otherwise be caused by the breakage in the periphery of the opening in the head end face or by the ooze of the ink. Thus, the ejection characteristics are uniformed by absorbing the errors due to the cutting or grinding step.

4 Claims, 4 Drawing Sheets

INK JET HEAD

BACKGROUND OF THE INVENTION

1. Field of the Invention

The present invention relates to a structure for an ink jet head.

2. Description of the Prior Art

There is in the prior art an ink jet head of the so-called "on-demand" type for printing by ejecting ink from a nozzle. This ink jet head is formed with a common ink chamber, a plurality of ink passages to be supplied with ink from the ink chamber, and a nozzle at the leading end of each ink passage. This ink passage is formed with a pressure chamber which is equipped with ink ejecting means such as a piezoelectric element for imparting flying force to the ink.

Most nozzles of the prior art are shaped to have their sectional areas gradually decreased from their entrances (located at the side of the ink chamber) toward their exits (at the side of a printing medium), as disclosed in Japanese Patent Laid-Open No. 178768/1982, or to have their sectional areas once decreased and restored to a constant value, as disclosed in Japanese Patent Publication No. 44549/1988. In either construction, the nozzle has the minimum sectional area at its exit and is opened in the head end face.

On the other hand, the nozzle having a construction, in which it is arranged on a common plane with the pressure chamber, is formed by etching or injection-molding a material of glass, metal, semiconductor or plastics to form a groove, subsequently by bonding the grooved material and a substrate member, and finally by cutting or grinding the head end face to a predetermined nozzle length. On the other hand, the construction having its pressure chamber and nozzle facing each other is made by adhering a substrate having ink ejecting means and a passage substrate.

In case the ink jet head is to be constructed by the aforementioned methods, the nozzle is liable to have its exit periphery broken or deformed at the cutting or grinding step.

If a nozzle a has its exit a1 broken at a2, as shown at the righthand side of FIG. 8, for example, ink droplets b have their surface tensions unbalanced when they leave the head end face, so that they go out of their intrinsic orbit c to another orbit d which is offset to the notch a2. Thus, correct printing cannot be achieved.

In another case, too, in which a nozzle e is constructed to have a normal exit e1, as shown at the left-hand side of FIG. 8, the ink will ooze to the nozzle periphery at the head end face, as the drive frequency rises. If the ooze is deviated, the ink droplets b will also brought out of the intrinsic orbit c to another orbit f by the tension to the oozing side, so that correct printing can neither be achieved.

There are still many problems in which the nozzle exit has its length changed with the resultant change in the ejection characteristics of the ink droplets by the errors in the cutting or grinding step. It is known that especially the portion having the smaller effective area will exert the more influences upon the ejection characteristics of the ink droplets. The above-specified constructions of the prior art are liable to cause errors in the nozzle exit having the minimum effective area so that they can hardly achieve the desired ejection characteristics.

SUMMARY OF THE INVENTION

It is, therefore, an object of the present invention to enable the ink droplets ejected always in a correct direction by suppressing the fluctuation of their flowing direction, which might otherwise be caused by the breakage in the periphery of the opening in the head end face or by the ooze of the ink, thereby to uniform the ejection characteristics by absorbing the errors due to the cutting or grinding step.

In order to achieve the above-specified object, according to the present invention, there is provided an ink jet head which comprises: an ink passage adapted to be supplied with ink; a nozzle communicating with the ink passage and positioned to have exit deep from the end face of an ink jet head; a hollow portion formed in the head end face to communicate with the nozzle exit and to have a larger diameter than the nozzle; and ink ejecting means disposed to correspond to the ink passage and energized electrically to eject the ink in the ink passage out of the nozzle end face through the hollow portion.

It is desired: that the distance from the nozzle exit to said head end face is 2 to 100 $\mu$m; that the hollow portion is formed with a tapered portion having its sectional area enlarged from its portion communicating with the nozzle toward the head end face whereas the tapered portion has a taper angle of 45 to 135 degrees at one side; and that the hydraulic diameter $\phi 2$ of the nozzle and the hydraulic diameter $\phi 1$ of the hollow portion opened in the head end face satisfy the relation of $\phi 1/\phi 2 \geqq 1.2$.

The ejection characteristics of the ink droplets depend upon the resistance component (acoustic resistance) and the inertial component (inertance) owned by the ink in the passage. Moreover, these values are generally the smaller for the portion having the smaller effective passage area. As described above, the ink jet head of the prior art has its head end face opening located at the exit of the nozzle and given the minimum effective area so that the nozzle exit exerts serious influences upon the ejection characteristics. Therefore, the present invention is enabled to achieve the desired ejection characteristics by positioning having the nozzle exit having the minimum effective area in a position deep from the head end face.

DESCRIPTION OF THE PREFERRED EMBODIMENTS

Figure 1:
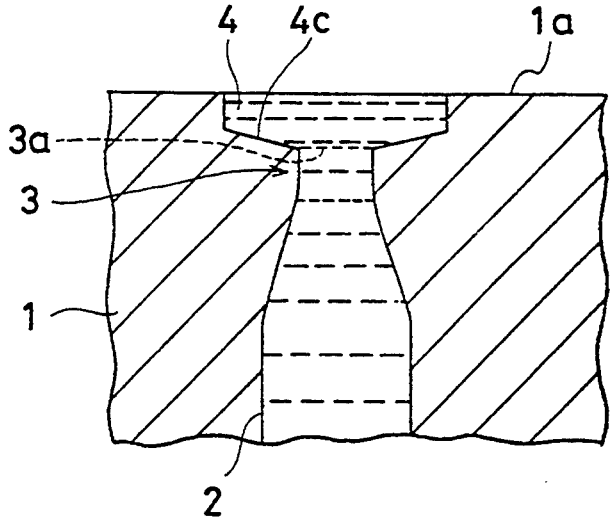
FIG. 1 is a section showing an essential portion of one embodiment of the present invention.
Figure 2:
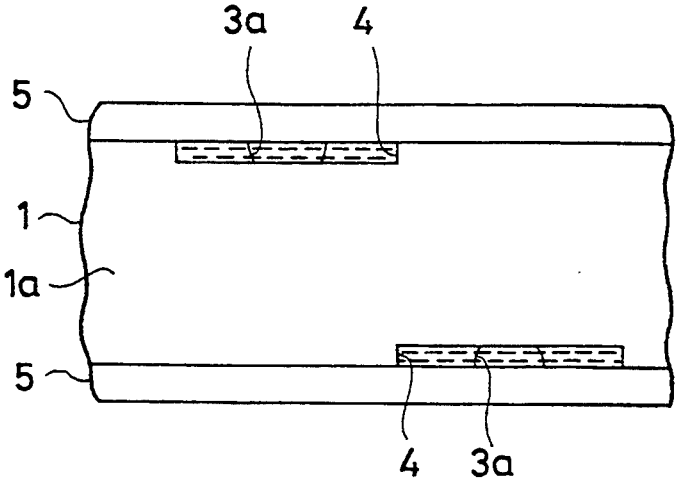
FIG. 2 is a front elevation showing the head end face of FIG. 1.

As shown in FIGS. 1 and 2, a plate-shaped passage substrate 1 its two faces formed in predetermined positions with grooves each for forming an ink passage 2, a nozzle 3 communicating with the passage 2, and a hollow portion 4 communicating with the nozzle 3. Substrate members 5 and 5 are mounted on the two faces of the passage substrate 1 in positions to face each other, thus defining the ink passages 2, the nozzles 3 and the hollow portions 4. The ink passage 2 is partially formed with a not-shown pressure chamber, in which is disposed ink ejecting means such as a piezoelectric element for compressing the ink in the ink passage 2 to eject an ink droplet through the hollow portion 4 from the nozzle 3. The nozzle 3 communicates with the ink passage 2 and has its exit 3*a* positioned deep from the head end face 1*a* and converged to have the minimum sectional area at the exit 3*a*. In the head end face 1*a*, moreover, there is formed the hollow portion 4 which communicates with the exit 3*a* of the nozzle 3 and has a larger diameter than that of the nozzle 3. This gives the minimum sectional area to the nozzle exit 3*a*, which is positioned deep in the head end face 1*a*, of all the remaining components the ink passage 2, the nozzle 3 and the hollow portion 4.

Figure 3:
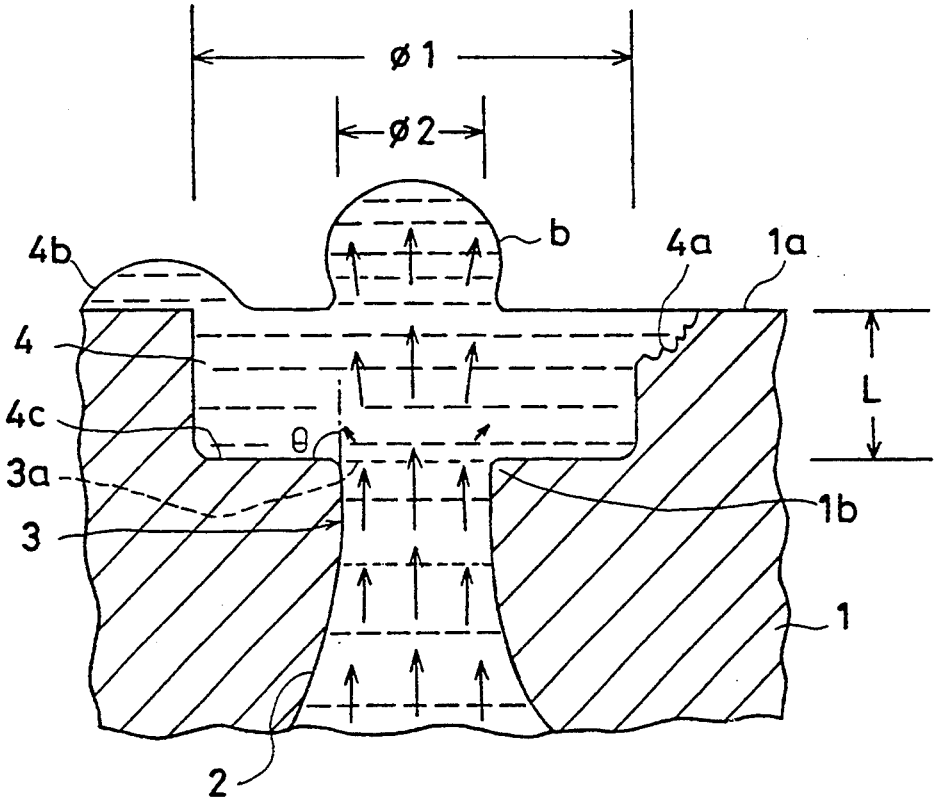
FIG. 3 is an enlarged section for explaining the principle of the ink flow of FIG. 1.

FIG. 3 illustrates the principle for compressing and ejecting the ink in the ink passage 2 from the nozzle 3. When the ink in the ink passage is compressed to start its flow, it acquires a flow velocity as high as 5 m/sec at its central portion so that it has a large momentum. As a result, the ink flow is not substantially influenced by the change in the effective area, even after it has reached the hollow portion to have its effective area abruptly increased, but is turned into an ink jet retaining its velocity and direction, as indicated by arrows, so that an ink droplet b will fly out of the head end face 1*a*. Specifically, the arrow indicate the flow velocity with their lengths and the flow direction with their orientations.

As could be understood from these flow velocity and direction of the ink jet, the portion in the hollow portion 4 outside of the nozzle 3 will hardly influence the inflow. Thus, the ejection characteristics of the ink droplet b are substantially influenced by neither notches 4*a* formed in the brim of the hollowing portion 4 nor ink droplets 4*b* sticking to the end face due to the ooze of the ink.

In order to establish these situations, the hollow portion 4 has to be shaped such that an angle $\theta$ defined by the direction of the ink jet flowing straight through the central portion of the exit 3*a* of the nozzle and the tapered portion 4*c* having a diverging area be 45 degrees or more at one side. Otherwise, namely, unless the angle $\theta$ should be less than 45 degrees, a meniscus to be formed at the head end face 1*a* after the ejection of the ink droplets b may fail to fall at the center of the nozzle exit 3*a*, thereby affect the subsequent ejection adversely. The particular angle $\theta$ is desirably within 135 degrees at the other side. Otherwise, namely, if the angle $\theta$ should exceed 135 degrees, the remaining portion (corresponding to the portion 1*b* of FIG. 3) forming the passage is so sharp and thin as to invite breakage or deformation.

In order to achieve the above-specified effect, moreover, the distance L from the head end face 1*a* to the nozzle exit 3*a* has to be 2 $\mu$m or more. Otherwise, namely, if the distance L is smaller than that value, the increase in the diameter of the hollow portion 4 causes no effect. If the distance L exceeds 100 $\mu$m, there arise other difficulties: the influences of the acoustic resistance or inertance of the hollow portion 4 upon the ink flow cannot be ignored; and the ink droplets b grow large. Thus, the distance L has to be within 100 $\mu$m.

In order to achieve the above-specified effects if the distance L from the head end face 1*a* to the nozzle exit 3*a* is short depending upon the shape of the head, it is desired that the hydraulic diameter $\phi 2$ of the nozzle exit 3*a* and the hydraulic diameter $\phi 1$ of the hollow portion 4 opened in the head end face 1*a* should satisfy the following relation: $\phi 1/\phi 2 \geqq 1.2$. This relation is achieved from the result of various experiments. Since the hydraulic diameter $\phi 1$ varies with the pitch of the nozzle 3, the desired effects can be achieved even for a small pitch if the ratio of $\phi 1/\phi 2$ is equal to or larger than 1.2.

Figure 4:
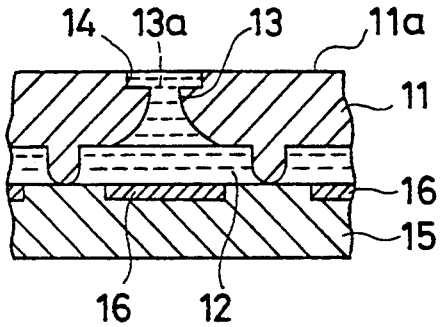
FIG. 4 is a section showing an essential portion of another embodiment of the present invention.
Figure 5:
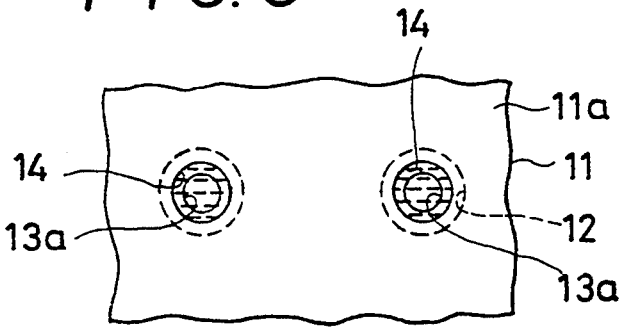
FIG. 5 is a front elevation showing the head end face of FIG. 4.

In the embodiment shown in FIGS. 1 and 2, the construction has its pressure chamber and nozzle 3 arranged in the common plane, but the nozzle 3 fails to face the ink ejecting means. On the other hand, another embodiment shown in FIGS. 4 and 5 is constructed to have its ink ejecting means and nozzle facing each other, and a passage substrate 11 has its one face formed into a head end face 11*a*, in which is opened a hollow portion 14. The other face of the passage substrate 11 is formed with an ink passage 12, which communicates with a nozzle 13. The hollow portion 14 communicating with the exit 13*a* of the nozzle 13 and has a construction similar to the aforementioned one.

The portion of the ink passage 12 facing the nozzle 13 acts as a pressure chamber. Thus, the ink ejecting means is formed to face the nozzle 13 by arranging a heating element as the ink ejecting means 16 on a substrate 15 facing the pressure chamber and by adhering the substrate 15 and the passage substrate 11. The principle of ejecting the ink droplets b in this embodiment is similar to that described with reference to FIG. 3.

Figure 6:
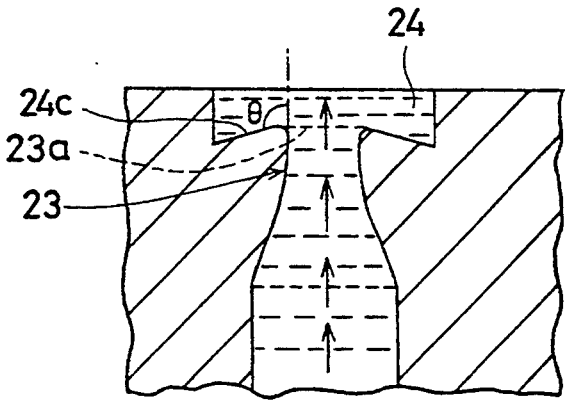
FIG. 6 is a section showing an essential portion of still another embodiment of the present invention.
Figure 7:
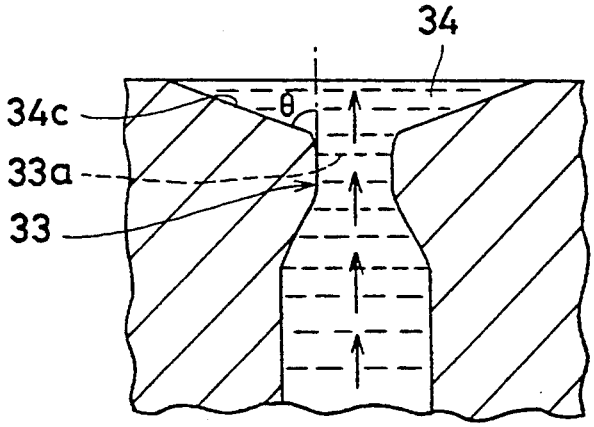
FIG. 7 is a section showing an essential portion of a further embodiment of the present invention.
Figure 8:
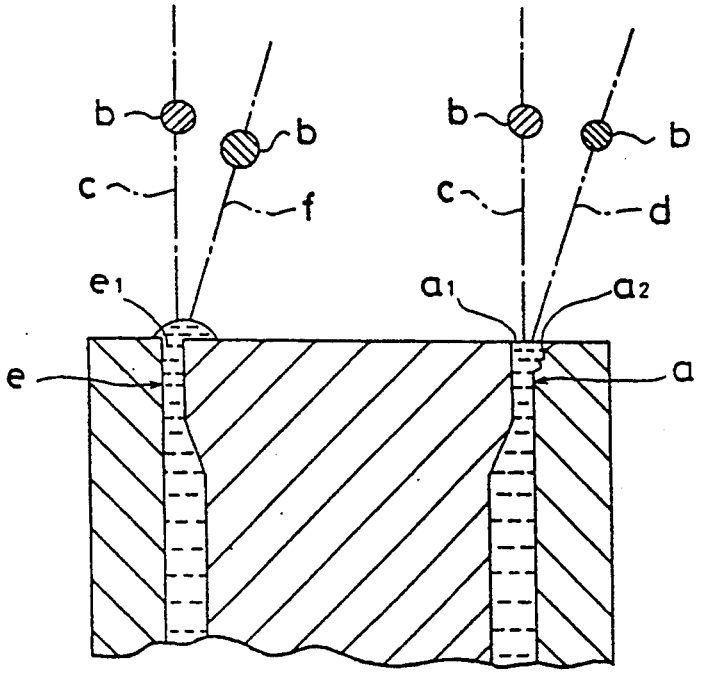
FIG. 8 PRIOR ART
FIG. 8 is a section for explaining the ink flowing orbits of the example of the prior art.

FIG. 6 shows a further embodiment, in which the exit 23*a* of a nozzle 23 and the tapered portion 24*c* of a hollow portion 24 are rounded at their angular portions, and FIG. 7 shows a further embodiment, in which the exit 33*a* of a nozzle 33 and the tapered portion 34*c* of a hollow portion 34 are chamfered at their angular portions. In either of these embodiments, the angle $\theta$ of the tapered portion 24*c* or 34*c* is defined by the direction of the ink jet flowing through the center of the nozzle exit 23*a* or 33*a* and the tapered portion 24*c* or 34*c* excepting the rounded or chamfered portions. Even if the angle $\theta$ should exceed 90 degrees but within 135 degrees, as shown in FIG. 6, the remaining portion for forming the passage would be reluctant to be broken or deformed and can be made more safe by rounding its angular portions. On the other hand, even if the angle $\theta$ should be less than 90 degrees but no less than 45 degrees, as shown in FIG. 7, the meniscus to be formed in the head end face after the ejection of the ink droplets b would come to just above the central portion of the nozzle exit 33*a* so that the subsequent ejection can be normalized.

As has been described hereinbefore, according to the present invention, the nozzle exit having the minimum sectional area is positioned deep from the head end face, and this head end face is formed with the hollow portion having a larger diameter than that of the nozzle. As a result, the ink droplets are not adversely affected in their flying direction, even if the ink should ooze to the periphery of the opening of the hollow portion, but can always be ejected in the correct direction. Even if, moreover, the head end face should be broken or deformed in the periphery of its opening during its cutting or grinding step, the flying direction of the ink droplets is not adversely affected while suppressing the fluctuation of the acoustic resistance or inertance. As a result, the ink droplets can be homogenized in their ejection characteristics so that they can be ejected at a predetermined rate in a predetermined flying direction.

What is claimed is:

1. An ink jet head comprising:

(A) a front end face, (B) a passage substrate, (C) an ink passage formed on said passage substrate and having a gradually narrowing front portion, (D) a nozzle of given diameter formed on said passage substrate, communicating with said front portion of said ink passage, and having an exit retreating from said front end face, (E) a hollow portion formed in said front end face, communicating with said exit of said nozzle, and having a diameter larger than said nozzle given diameter, and (F) an ink ejecting means corresponding with said ink passage so as to eject ink therefrom;

characterized in that:

(i) the distance from said nozzle exit to said front end face is 2 to 100 $\mu$m, (ii) said hollow portion is formed with a tapered portion where it communicates with said exit of said nozzle, and said tapered portion has a taper angle of 45° to 135°, and (iii) said hollow portion formed in said front end face has an equivalent diameter D1 and said nozzle has an equivalent diameter D2, said equivalent diameter satisfying the relation of $D1/D2 > 1.2$.

2. An ink jet head according to claim 1, wherein said tapered portion has a taper angle of 90° to 135°.

3. An ink jet head according to claim 1, wherein said nozzle is formed in situ on said passage substrate.

4. An ink jet head according to claim 3, wherein said nozzle is formed by etching.

* * * * *